US010370943B2

(12) United States Patent
El Nekhily et al.

(10) Patent No.: US 10,370,943 B2
(45) Date of Patent: Aug. 6, 2019

(54) WELL CONTROL USING A MODIFIED LINER TIE-BACK

(71) Applicant: Saudi Arabian Oil Company, Dhahran (SA)

(72) Inventors: Mohamed M. El Nekhily, Al-Khobar (SA); Nasser M. Al-Hajri, Abqaiq (SA); Ibraheem M. Al-Ageel, Dammam (SA); Ibrahim A. Al-Obaidi, Khobar (SA); Adib A. Al-Mumen, Damman (SA)

(73) Assignee: Saudi Arabian Oil Company, Dhahran (SA)

( * ) Notice: Subject to any disclaimer, the term of this patent is extended or adjusted under 35 U.S.C. 154(b) by 343 days.

(21) Appl. No.: 15/286,786

(22) Filed: Oct. 6, 2016

(65) Prior Publication Data

US 2018/0100380 A1 Apr. 12, 2018

(51) Int. Cl.

| | |
|---|---|
| ***E21B 43/10*** | (2006.01) |
| ***E21B 33/124*** | (2006.01) |
| ***E21B 33/13*** | (2006.01) |
| ***E21B 34/06*** | (2006.01) |

(Continued)

(52) U.S. Cl.

CPC ..... *E21B 43/10* (2013.01); *E21B 29/10* (2013.01); *E21B 33/124* (2013.01); *E21B 33/13* (2013.01); *E21B 34/06* (2013.01); *E21B 47/10* (2013.01); *E21B 47/1025* (2013.01)

(58) Field of Classification Search

CPC ..... E21B 43/10; E21B 29/10; E21B 47/1025; E21B 33/12; E21B 34/06; E21B 47/10

See application file for complete search history.

(56) References Cited

U.S. PATENT DOCUMENTS 1,652,472 A * 12/1927 Erwin ..... E21B 47/10 137/517

3,194,310 A * 7/1965 Loomis ..... E21B 27/02 166/250.08

(Continued)

FOREIGN PATENT DOCUMENTS

GB 2311312 9/1997

OTHER PUBLICATIONS

Schlumberger Oilfield Glossary entry for "crossflow", accessed Nov. 8, 2018 via www.glossary.oilfield.slb.com.*

(Continued)

*Primary Examiner* — Blake E Michener

(74) *Attorney, Agent, or Firm* — Fish & Richardson P.C.

(57) ABSTRACT

One example of a wellbore control tool and a method of use is described. A leak is detected in a cased wellbore comprising a multiple telescoping casing sections. A fluid flows in an uphole direction through the cased wellbore. A flow of the fluid in the uphole direction results in a first force in the uphole direction. The leak is in a first telescoping casing section. An open downhole end of a wellbore tool having a weight at least equal to a second force greater than the first force on an uphole end of a second telescoping casing section that is downhole from a location of the leak in the first telescoping casing section is seated. The open downhole end of the wellbore tool provides metal to metal contact against the uphole end of the second telescoping casing section and restricts fluid flow into the leak.

10 Claims, 9 Drawing Sheets

(51) Int. Cl.
*E21B 47/10* (2012.01)
*E21B 29/10* (2006.01)

(56) References Cited

U.S. PATENT DOCUMENTS

| | | | | | |
|---|---|---|---|---|---|
| 3,199,598 | A * | 8/1965 | Loomis | E21B 27/02 | 138/97 |
| 3,323,360 | A * | 6/1967 | Nutter | E21B 47/10 | 166/127 |
| 3,424,244 | A * | 1/1969 | Kinley | E21B 29/10 | 166/114 |
| 4,046,405 | A * | 9/1977 | Bonds | E21B 36/003 | 166/208 |
| 4,585,967 | A | 4/1986 | Mayer et al. | | |
| 5,507,343 | A * | 4/1996 | Carlton | E21B 29/10 | 166/114 |
| 6,065,550 | A | 5/2000 | Gardes | | |
| 6,209,663 | B1 | 4/2001 | Hosie | | |
| 6,367,566 | B1 | 4/2002 | Hill | | |
| 6,732,804 | B2 | 5/2004 | Hosie | | |
| 7,017,670 | B2 * | 3/2006 | Hazel | E21B 29/10 | 166/382 |
| 7,048,067 | B1 * | 5/2006 | Cook | E21B 29/10 | 166/207 |
| 7,032,662 | B2 | 8/2006 | de Boer | | |
| 7,090,036 | B2 | 8/2006 | de Boer | | |
| 2004/0079534 | A1 * | 4/2004 | Harrall | E21B 29/10 | 166/380 |
| 2006/0196678 | A1 * | 9/2006 | Connell | E21B 29/10 | 166/380 |
| 2012/0097391 | A1 * | 4/2012 | Whiddon | E21B 29/10 | 166/277 |
| 2012/0175108 | A1 * | 7/2012 | Foubister | E21B 33/1294 | 166/250.01 |
| 2015/0292305 | A1 * | 10/2015 | Galloway | E21B 43/105 | 166/380 |
| 2016/0138361 | A1 * | 5/2016 | Clemens | E21B 29/10 | 166/387 |
| 2016/0251933 | A1 * | 9/2016 | Gharesi | F16J 15/38 | 166/387 |
| 2016/0362959 | A1 * | 12/2016 | Zhou | E21B 43/10 | |
| 2017/0321522 | A1 * | 11/2017 | Al-Hajri | E21B 43/00 | |

OTHER PUBLICATIONS

Jahn et. "Hydrocarbon Exploration and Production: 3.0 Drilling Engineering," Elsevier, Mar. 13, 1998, 16 pages.

Abedel-Aal et al., "Chapter 1: Oil and Gas, From Formation to Production," Taylor & Francis, Jul. 3, 2003, 42 pages.

Alhashimi, "Liner tie-backs stop casing leaks in Libyan completions—Oil & Gas Journal," Oil & Gas Journal, vol. 105 (1), Jan. 1, 2007, 12 pages.

International Search Report and Written Opinion in International Application No. PCT/US/2017/054926, dated Feb. 5, 2018, 18 pages.

* cited by examiner

WELL CONTROL USING A MODIFIED LINER TIE-BACK

TECHNICAL FIELD

This specification relates to well control.

BACKGROUND

In hydrocarbon production, a wellbore is drilled into a geologic formation and production fluids containing hydrocarbons travel from the geologic formation to a topside facility through the wellbore. The wellbore is sometime cased with telescoping sections of casing. The completed wellbore with all of the necessary infrastructure in place is called a well. At times, a well can be uncontrolled. An uncontrolled well has high pressure fluid rushing in an uphole direction from a deep, high pressure formation in the wellbore. There are several methods for controlling, or "killing" a well, such as bullheading, dynamic killing, and placing a mechanical downhole plug.

SUMMARY

This specification describes technologies relating to well control using a modified liner tie-back.

Certain aspects of the subject matter described here can be implemented as a method. A leak is detected in a cased wellbore with multiple telescoping casing sections. A fluid is flowing in an uphole direction through the cased wellbore. A flow of the fluid in the uphole direction results in a first force in the uphole direction. The leak is in a first telescoping casing section. In response to detecting the leak, an open downhole end of a wellbore tool having a weight at least equal to a second force greater than the first force on an uphole end of a second telescoping casing section that is downhole from a location of the leak in the first telescoping casing section is seated. The open downhole end of the wellbore tool provides metal to metal contact against the uphole end of the second telescoping casing section and restricts fluid flow into the leak.

The fluid flowing in the uphole direction flows into at least a portion of the wellbore tool. The wellbore tool includes a unidirectional valve uphole of the open downhole end of the wellbore tool, the unidirectional valve prevents upward flow of the fluid towards the surface. A kill fluid is pumped from the surface through an uphole end of the wellbore tool. The kill fluid provides a hydrostatic head sufficient to prevent the fluid from flowing in the uphole direction. A mechanical barrier is installed below the wellbore tool after the fluid flowing in an uphole direction through the cased wellbore has been stopped. The wellbore tool includes a wellbore tool sub-assembly connected to an uphole end of the unidirectional valve, the wellbore tool sub-assembly extending to the surface of the wellbore, the wellbore tool sub-assembly including a first pipe connected to the uphole end of the unidirectional valve, a second pipe connected to a downhole end of the unidirectional valve, a liner running wellbore tool connected to a downhole end of the second pipe with a downhole end of the liner running wellbore tool is configured to connect to a liner tie-back sleeve, a casing joint configured to connect to a downhole end of the liner tie-back sleeve, a packer connected to an uphole end of the casing joint, and a modified liner tie-back stem connected to a downhole end of the casing joint. The open downhole end of the wellbore tool is a downhole end of the liner modified tie-back stem. The liner running tool, the first pipe, the unidirectional valve, and the wellbore tool sub-assembly are removed from the wellbore. The packer, the casing joint and the modified liner tie-back stem remain in the wellbore. The wellbore tool further includes one or more O-rings attached to an outer surface of the modified liner tie-back stem. The method further includes additionally sealing the open downhole end of the wellbore tool against the uphole end of the second telescoping casing section using the one or more O-rings. Either the first pipe or the second pipe can be a drill collar. An absence of fluid flow in the wellbore is determined. In response to determining the absence of the fluid flow in the wellbore, the packer, the casing joint, and the modified liner tie-back stem are removed. Repair of the leak is initiated after removing the packer, the casing joint, and the modified liner tie-back stem. Determining the absence of the fluid flow in the wellbore includes lowering a flowmeter into the wellbore, and measuring a rate of the fluid flow in the wellbore using the flowmeter. The modified liner tie-back stem includes a liner tie-back stem without a half mule shoe. The cased wellbore is an injection wellbore. The cased wellbore is formed in a formation with multiple zones. The leak is a cross flow from a first zone to a second zone that is uphole of the first zone and at a lower pressure than the first zone.

Certain aspects of the subject matter described here can be implemented as a wellbore tool. The wellbore tool configured to kill a cased wellbore with a leak, the wellbore tool includes multiple wellbore tool components including a modified liner tie-back stem including an open downhole end contacting an uphole end of a casing section of multiple casing sections installed in the cased wellbore and diverts fluid flowing in an uphole direction away from the leak in the cased wellbore, and a unidirectional valve connected uphole of the modified liner tie-back stem, the unidirectional valve receives the diverted fluid and to prevent flow of the diverted fluid in the uphole direction. A weight of the multiple wellbore tool components is at least equal to a force in the uphole direction caused by the flow of the fluid in the uphole direction.

The multiple wellbore tool components further include a casing joint configured to connect to a liner tie back sleeve connects to an uphole end of the modified liner tie-back stem, a packer connected to an uphole end of the casing joint, a liner running tool connected to an uphole end of the liner tie-back sleeve with a downhole end of the liner running tool is configured to connect to the liner tie-back sleeve, a first pipe connected to an uphole end of the liner running tool with the unidirectional valve connected to an uphole end of the first pipe, and a wellbore tool sub-assembly connected to an uphole end of the unidirectional valve, the wellbore tool sub-assembly extending to a surface of the wellbore, the wellbore tool sub-assembly includes a second pipe connected to the uphole end of the unidirectional valve. Either the first pipe or the second pipe can be a drill collar. The packer is connected to an outer surface of the casing joint. The packer does not include slips. The modified liner tie-back stem includes a liner tie-back stem without a half mule shoe. One or more O-rings are attached to an outer surface of the modified liner tie-back stem. One or more O-rings are additionally seal the open downhole end of the wellbore tool against the uphole end of the casing section. An inner diameter of the modified liner tie-back stem is substantially equal to an inner diameter of the casing section. An outer diameter of the modified liner tie-back stem is less than an inner diameter of a casing tie-back sleeve.

Certain aspects of the subject matter described here can be implemented as a method. In a cased wellbore with multiple telescoping casing sections, a fluid is flowing in an uphole direction through the cased wellbore. A flow of the fluid in the uphole direction results in a first force in the uphole direction. A first telescoping casing section has a leak. An open downhole end of a wellbore tool having a weight at least equal to a second force greater than the first force on an uphole end of a second telescoping casing section that is downhole from a location of the leak in the first telescoping casing section is seated. The wellbore tool includes a modified liner tie-back stem including the open downhole end that contacts with the uphole end of the second telescoping casing section and configured to divert the fluid flowing in the uphole direction away from the leak, a casing joint connected to an uphole end of the modified liner tie-back stem, a packer connected to an uphole end of the casing joint with an uphole end of the casing joint configured to connect to a liner tie-back sleeve, a liner running tool configured to connect to an uphole end of the liner tie-back sleeve, a first pipe connected to an uphole end of the liner running tool, a unidirectional valve connected to an uphole end of the first pipe, the unidirectional valve configured to receive the diverted fluid and to prevent flow of the diverted fluid in the uphole direction, and a wellbore tool sub-assembly connected to an uphole end of the unidirectional valve, the wellbore tool sub-assembly includes a second pipe connected to the uphole end of the unidirectional valve.

The details of one or more implementations of the subject matter described in this specification are set forth in the accompanying drawings and the description below. Other features, aspects, and advantages of the subject matter will become apparent from the description, the drawings, and the claims.

BRIEF DESCRIPTION OF THE DRAWINGS

Like reference numbers and designations in the various drawings indicate like elements.

DETAILED DESCRIPTION

This specification describes a downhole wellbore control tool which is capable of controlling, or "killing" a well, for example, as an alternative to or in addition to techniques such as bullheading, dynamic killing, or plugging. Killing a well only temporarily stops the flow, that is, the process can be reversed at a later time. For example, the wellbore tool can be implemented in a high-velocity cross flow within a wellbore. Cross flow occurs when a wellbore passes through both deep, high pressure zone in a geologic formation and a shallower, low pressure zone in a geological formation. Fluid flows from the high pressure zone to the low pressure zone. The flow is often initiated by a leak in the casing of the wellbore where it passes through the low pressure zone. The wellbore tool works by sealing off the well flow between the flow source and the flow destination. The wellbore tool accomplishes the seal by providing a weight greater than the fluid force in the opposite direction of the fluid flow. The weight of the wellbore tool allows a metal-to-metal contact to be formed between the wellbore tool and the wellbore casing section downhole to the location of the leak. Once the contact is made, killing fluid can be pumped down the wellbore and through the tool to kill the well. The wellbore tool can then be removed and the wellbore can be prepared to repair the leak.

Figure 1:
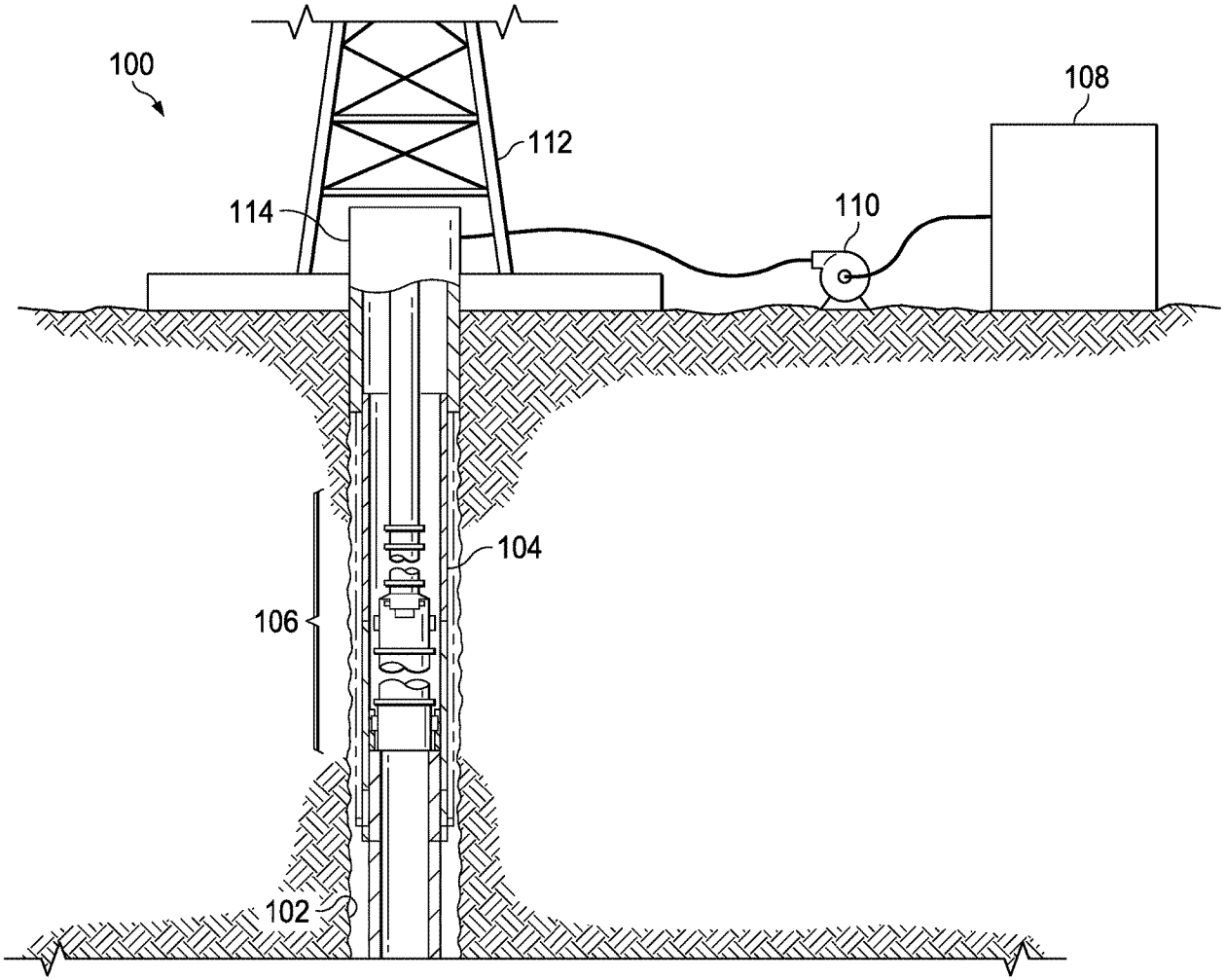
FIG. 1 is a schematic diagram of a wellbore tool positioned in a cased wellbore formed in a formation.

FIG. 1 shows a schematic diagram of a wellbore tool 106 positioned in a cased wellbore 102 drilled into a formation. In some implementations, the wellbore 102 can be a production wellbore. In a production wellbore, hydrocarbons flow from a geological formation to a topside facility. In some implementations, the wellbore 102 can be an injection wellbore. In an injection wellbore, injection fluid, such as brine, fresh water, or gas, is injected from a topside facility into a geological formation. Any wellbore, whether it be an injection wellbore or a production wellbore, needs to be killed if repairs need to be made. Repairs need to be made for several circumstances, such as a leak in a section of well casing.

As described here, the wellbore tool 106 is implemented to kill the cased wellbore 102 by having a weight greater than an upward force generated by fluid flowing in the uphole direction. Killing the cased wellbore 102 can be necessitated by a cross flow in the cased wellbore 102, that is, a flow of fluid in an uphole direction from a deep, high pressure zone to a comparatively shallow low pressure zone. Kill set-up 100 includes the wellbore tool 106 positioned within the wellbore 102 lined with multiple sections of casing 104. The multiple sections of casing 104 telescope down into the wellbore 102 with the smaller diameter sections at the downhole end. The multiple sections of casing 104 can be made of metal pipe and can be anchored into the walls of the wellbore 102 by placing cement between the casing and the formation. The casing metal can be low carbon steel, chromium 13 or other similar material. Positioned at the uphole end of the wellbore 102 is a blow out preventer (BOP) 114. The BOP 114 includes any valves or sealing capability necessary to do the work described in this specification. Work-over rig 112 is erected around the BOP 114 to position the wellbore tool 106 within the wellbore 102. The work-over rig 112 supports the weight of the wellbore tool 106 as the wellbore tool 106 is inserted and removed from the wellbore. While FIG. 1 shows an implementation used for on-shore applications, there can be similar implementations in an off-shore environment.

Killing fluid is stored in a fluid tank 108 and is pumped through wellbore tool 106 with mud pump 110. The mud pump 110 has sufficient head and flow capabilities to overcome the pressure and flow coming up from the uncontrolled well. In some implementations, the mud pump 110 is a positive displacement pump, such as a plunger pump. The killing fluid has a density greater than water and is configured prior to any killing operations occur to have adequate density to provide a heavy enough hydrostatic column to kill the wellbore 102. The density of the killing fluid calculated to have an accepted overbalance pressure value over the expected reservoir pressure. The killing fluid can be water or petroleum based and is also referred to as "mud".

Prior to killing the cased wellbore 102 with kill fluid, the wellbore tool 106 can be implemented to seal a leak in a casing section in the wellbore. To do so, the wellbore tool 106 can be lowered into the cased wellbore 102 to a location below the leak as described below with reference to FIG. 2.

Figure 2:
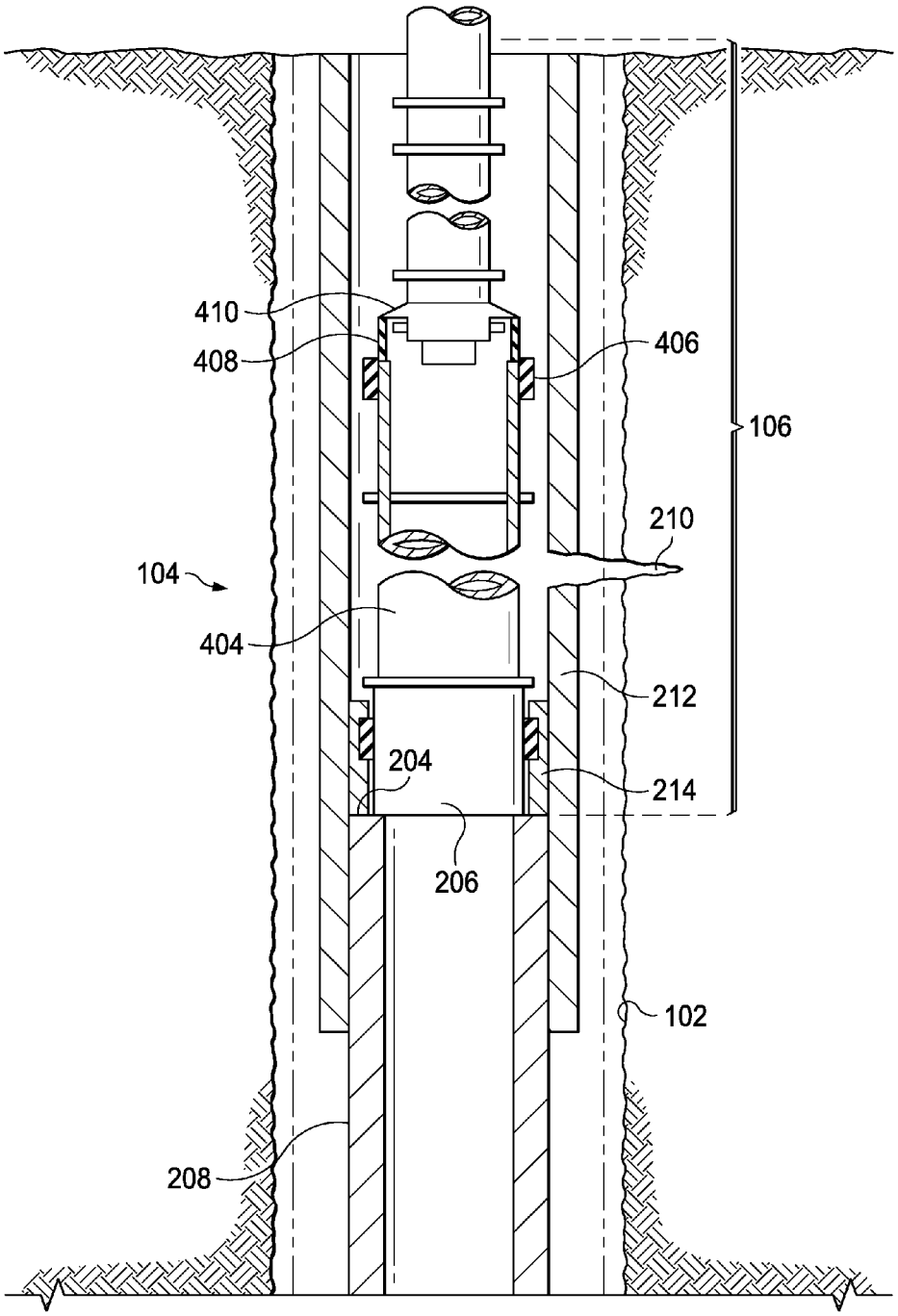
FIG. 2 is a schematic diagram of the wellbore tool positioned in the cased wellbore.

FIG. 2 shows a schematic diagram of the wellbore tool 106 positioned within the cased wellbore 102. As shown in FIG. 2, the wellbore 102 includes a leak 210 in one of the casing sections. Casing leaks can be caused by corrosion, erosion, faulty installation, physical damage by a tool, or any other physical trauma. In the case of an injection well, a leak in the wellbore 102 can result in cross flow or improper injection. Cross flow occurs when a wellbore flow passes through both deep, high pressure zone in a geologic formation and a shallower, low pressure zone in a geological formation. Fluid flows from the high pressure zone to the low pressure zone. Cross flow in an injection well typically occurs while a well is shut-in. Improper injection occurs when injection fluid is injected through the leak into the wrong part of a geological formation. Improper injection can lead to a flow reduction in the targeted part of a reservoir, over pressuring the wrong part of the reservoir, loss of well integrity, and environmental damage.

In the case of a production well, a leak in wellbore 102 can result in crossflow during production. Cross flow during production occurs when a wellbore flow passes through both deep, high pressure zone in a geologic formation and a shallower, low pressure zone in a geological formation. Part of the production fluid flows from the high pressure zone to the low pressure zone rather than up to the topside facility. Production crossflow results in an apparent reduction in production of the wellbore 102. Cross flow during production can also lead to environmental damage and a loss of well integrity. The wellbore tool 106 can be used to control any of the leaks described here.

The downhole end 206 of the wellbore tool 106 is open to receive fluid flowing through the wellbore 102 in the uphole direction. The open downhole end 206 of the wellbore tool 106 is seated against an uphole end 204 of casing section 208. Casing section 208 is the casing section immediately downhole of a leaking casing section 212 containing casing leak 210 and has a casing tie-back sleeve 214 at its uphole end. Wellbore tool 106 diverts fluid flow away from the leak 210. When the downhole end 206 of the wellbore tool 106 is positioned on the uphole end 204 of the casing section 208, the weight of the wellbore tool 106 provides a flow restriction, through a metal-to-metal contact, between the open downhole end 206 of the wellbore tool 106 and the uphole end 204 of casing section 208. In some implementations, the metal-to-metal contact can form a seal between the open downhole end 206 and the uphole end 204. In some implementations, the contact may not entirely form the seal, but can decrease fluid flow and diverts most of the fluid in an uphole direction away from the leak in the cased wellbore. The fluid flows in the uphole direction through the wellbore tool 106. As described later, the wellbore tool 106 includes features that stop the fluid flow within the wellbore tool 106, thereby preventing the fluid from flowing upward toward a surface of the wellbore 102.

As described earlier, the weight of the wellbore tool 106 provides enough force to provide a sufficient contact with the uphole end 204 of the casing section 208. In addition, the inner diameter of the wellbore tool 106 is substantially equal to an inner diameter of the casing section 208. By "substantially," it is meant that a difference between the inner diameter of the wellbore tool 106 and the inner diameter of the casing section 208 is between 5% and 10% of the inner diameter of the wellbore tool 106. Substantially matching the inner diameters of the wellbore tool 106 and the inner diameter of the casing section 208 allows the wellbore tool 106 to seat on the uphole end 204 of casing section 208.

The outer diameter of the wellbore tool 106 is less than an inner diameter of the leaking casing section 212 to allow the wellbore tool 106 to slide past the casing leak 210. If the outer diameter of the wellbore tool 106 is greater than the inner diameter of the leaking casing section 212, there would be an interference between the wellbore tool 106 and the leaking casing section 212. Also, the outer diameter of the downhole end 206 is greater than an inner diameter of the casing section 208, in particular, the inner diameter of the uphole end 204 of the casing section 208, to allow the downhole end 206 of the wellbore tool 106 to sit on the uphole end 204 of the casing section 208. In some implementations, a wall thickness of the downhole end 206 of the wellbore tool 106 can be maximized to increase a contact area with the wall of the uphole end 204 of the casing section 208. The increased contact area can increase a strength of the flow restriction between the wellbore tool 106 and the casing section 208.

Figure 3:
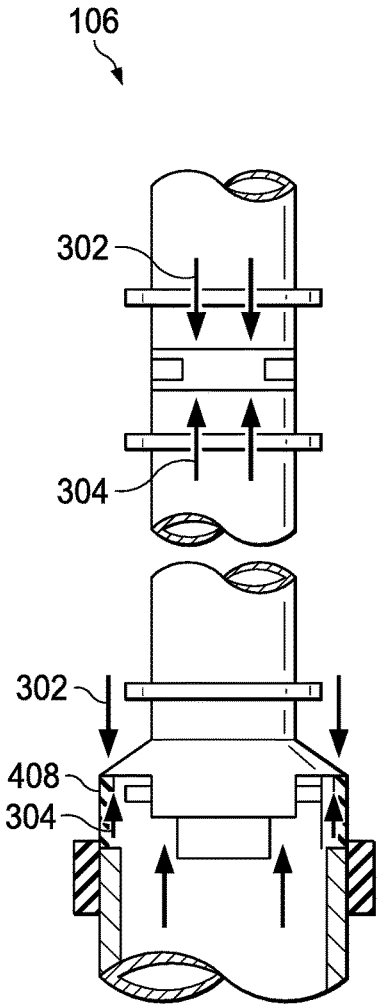
FIG. 3 is a schematic diagram showing upward and downward forces on the wellbore tool.

FIG. 3 is a schematic diagram showing the upward forces 304 and downward forces 302 acting on the wellbore tool 106. The weight of the wellbore tool 106 is a primary counter force against the upward forces 304. The wellbore tool 106 is assembled such that the weight of the wellbore tool 106 provides a greater downward force 302 than the upward forces 304 imparted by well fluids flowing in the opposite direction. Because the downward forces 302 are greater than the upward forces 304, the wellbore tool 106 forms and maintains the metal-to-metal contact between the open downhole end 206 of the wellbore tool 106 and the uphole end 204 of the casing section 208 to divert the uncontrolled well fluids into the body of the wellbore tool 106.

After the wellbore tool 106 has been lowered into and seated on the casing section 208 to divert the fluid flow into the body of the wellbore tool 106, the wellbore tool 106 can be implemented to control or "kill" the cased wellbore 102. Features of the wellbore tool 106 to implement such controlling or "killing" are described below with reference to FIG. 4.

Figure 4:
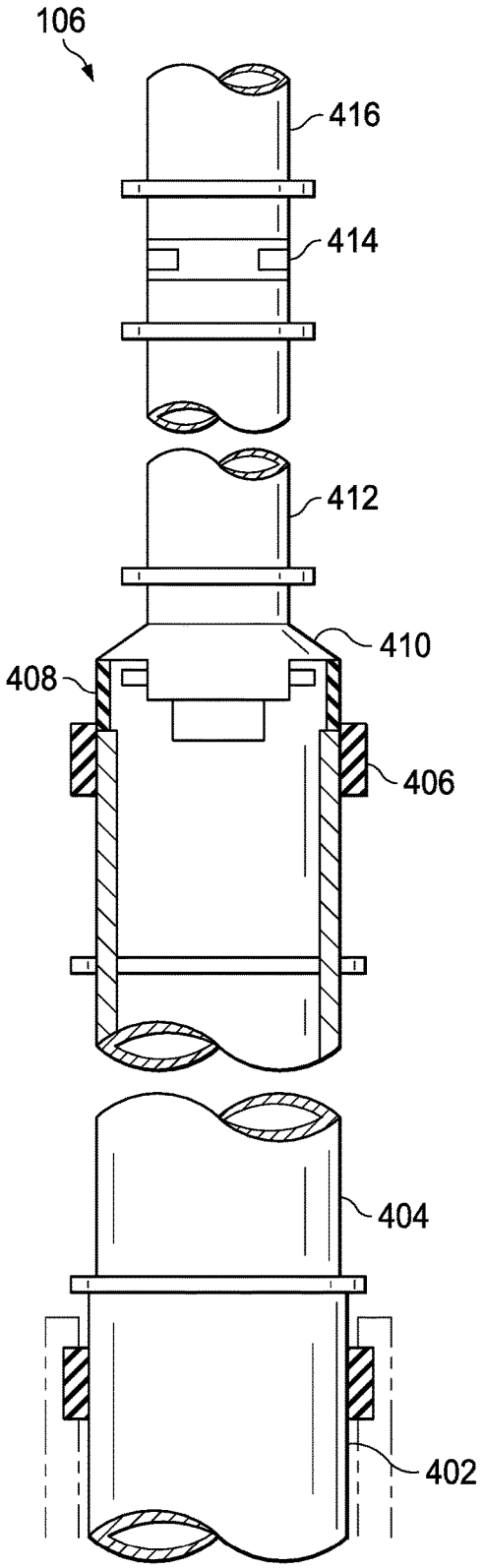
FIG. 4 is a schematic diagram showing tool components of the wellbore tool.

FIG. 4 is a schematic diagram showing components of the wellbore tool 106. A modified liner tie-back stem 402 is on the downhole end of the wellbore tool 106. Immediately uphole of the modified liner tie-back stem 402 is a casing joint 404. In some implementations, one casing joint 404 can be used, while, in others, multiple casing joints can be utilized based on the desired length and weight of the wellbore tool 106. A top packer 406 is attached to the uphole end of casing joint 404. The top packer 406 is attached to the outer surface of the casing joint 404. The top packer provides a secondary seal between the wellbore tool 106 and the leaking well casing 212. The top packer 406 also provides partial hanging support for wellbore tool 106, for example, to hold the wellbore tool 106 in place. In some implementations, the top packer 406 can be implemented without slips to enable future retrieval of the top packer 406. The top packer 406 may also act as a centralization tool for wellbore tool 106 as the top packer 406 has outer diameter greater than the outer diameter of wellbore tool 106. The outer diameter of top packer 406 is less than the inner diameter of casing section 212. The top packer can be placed uphole of the leak 210 to prevent fluid flow between the top of the tool and leak 210. A liner tie-back sleeve 408 is also attached to the uphole end of the casing joint 404 while a liner running tool 410 is attached to the uphole end of the liner tieback sleeve 408 The liner running tool 410 is released via any method known in the art mechanically or hydraulically. A first pipe 412 is attached to the uphole end of the liner running tool 410. A flow control sub 414 is attached to the uphole end of the first pipe 412. For example, the flow control sub 414 can be a check valve or other unidirectional valve that permits fluid flow in the downhole direction but not in the uphole direction. A second pipe 416 is connected to the uphole end of the flow control sub 414 and extends up to the BOP 114. The first pipe 412 and the second pipe 416 can be standard drill pipe, drill collars, or heavy weight drill pipe depending on the weight required. Heavier casing sections can be used for casing joint 404 as well.

The modified liner tie-back stem 402 is the component of the wellbore tool 106 that sits on and provides the metal to metal contact against the uphole end 204 of the casing section 208, that is, the casing section immediately downhole of the casing section with the leak. The modified liner tie-back stem 402 and casing joint 404 divert the uncontrolled well fluid flow away from its initial flow path to the flow control sub 414. The uncontrolled well fluid flow in the uphole direction is stopped by the flow control sub 414 because the flow control sub 414 is configured to only allow flow in the downhole direction. The flow control sub 414 contains a passive check valve, such as a flapper check valve.

As described earlier, the inner diameter of the modified liner tie-back stem 402 is substantially equal to an inner diameter of the casing section 208, and the outer diameter of the modified liner tie-back stem 402 is less than an outer diameter of the casing section 208. The modified liner tie-back stem 402 is constructed by modifying a liner tie-back stem as described with reference to FIGS. 5A and 5B.

Figure 5A:
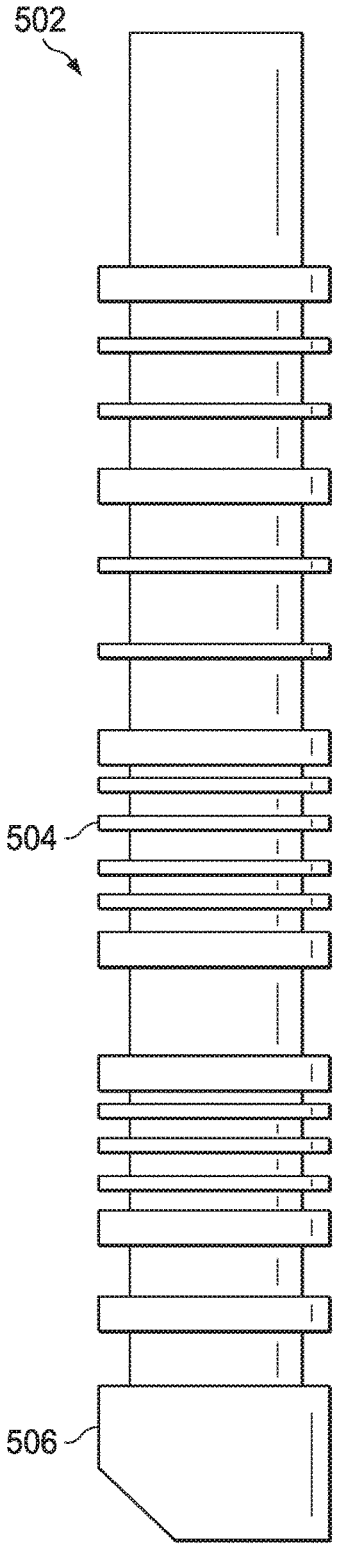
PRIOR ART FIG. 5A
FIG. 5A and FIG. 5B are schematic diagrams of a tie-back stem and a modified tie-back stem, respectively.
Figure 5B:
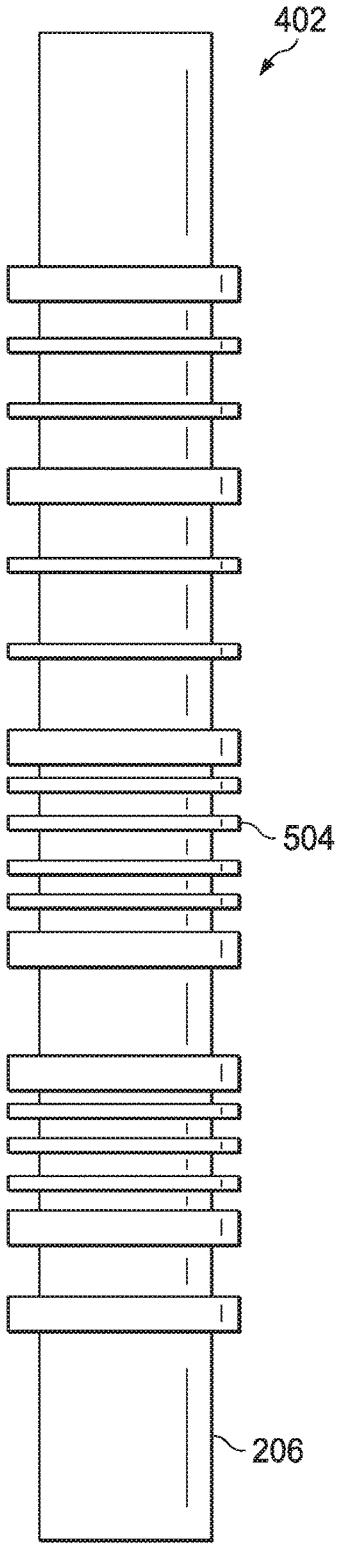

FIG. 5A shows a schematic of an example unmodified tie-back stem 502. A half mule shoe 506 is attached at the downhole end of the unmodified tie-back stem 502. The unmodified tie-back stem 502 has several O-rings 504 that can be used for secondary sealing. FIG. 5B shows a schematic of an example modified liner tie-back stem 402 that can be utilized in wellbore tool 106. The modified liner tie-back stem has had the half mule shoe 506 removed to allow for the metal to metal contact in the wellbore 102. The modified liner tie-back stem 402 also has several O-rings 504 that can be used for secondary sealing in addition to the metal to metal contact achieved from the open downhole end 206 of the modified liner tie-back stem 402. The unmodified tie-back stem 502 can be implemented in a static wellbore for preventive maintenance or remedial work. In contrast, the modified tie-back stem 504 can be installed, that is, run into the cased wellbore 102, under dynamic flow regime. For example, the wellbore tool 106 including the modified tie-back stem 402 can be installed under dynamic cross flow regime to divert the uncontrolled well fluids in an uphole direction away from the leak in the cased wellbore into the body of the wellbore tool 106.

Figure 6:
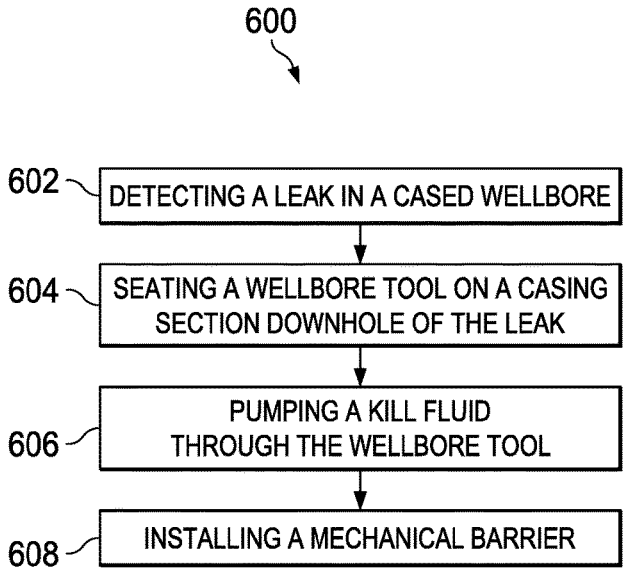
FIG. 6 is a flowchart of an example process of killing a wellbore using the wellbore tool of FIG. 1.

FIG. 6 is a flowchart of an example process 600 for killing a wellbore using wellbore tool 106. At 602, a leak is detected in a cased wellbore. For example, the leak in the cased wellbore 102 can result in a cross flow of fluid flowing through the cased wellbore 102 in an uphole direction. The cross flow can cause fluid from a deep high pressure zone to flow through the leak into a shallow low pressure zone.

Figure 7A:
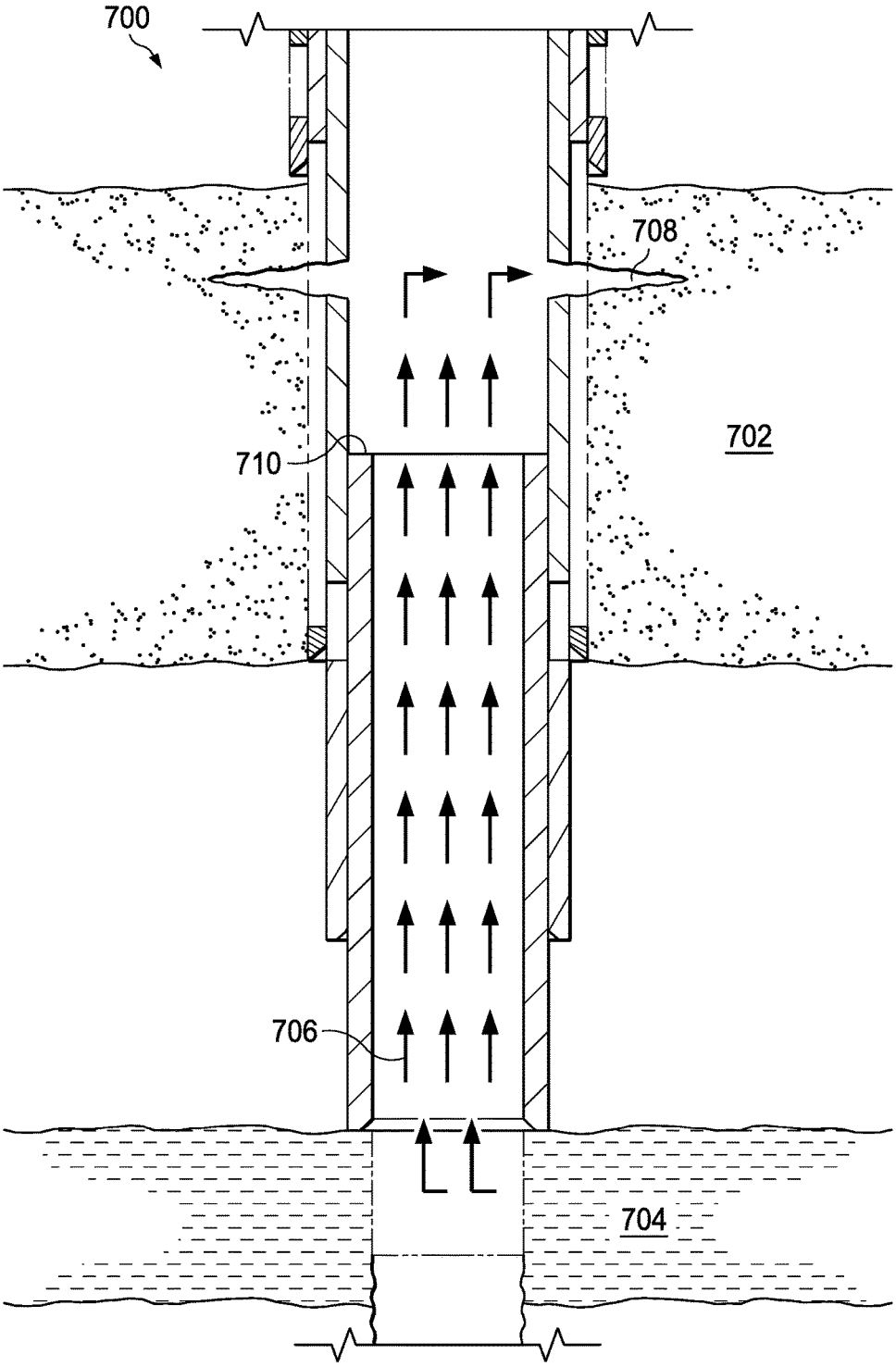
FIG. 7A is a schematic diagram of an example of cross flow in an injection wellbore.

FIG. 7A shows a schematic diagram of an example injection well 700 experiencing cross flow that wellbore tool 106 can be used to kill. In the example of FIG. 7A, injection well 700 has a leak 708 in a low-pressure zone 702. The leak 708 allows fluid to flow from high-pressure zone 704 to low-pressure zone 702 in an uphole direction through a cased wellbore. The upward fluid flow 706 in this scenario can be greater than 5,000 barrels per day. In general, the upward fluid flow can have any volumetric flowrate, for example, a volumetric flowrate that is so high that the injection well 700 cannot be killed using techniques such bullheading, dynamic killing, or placing a mechanical downhole plug. The leak 708 can be detected through a variety of techniques, such as observing an unusual change in wellhead pressure, by conducting temperature surveys, or any other techniques.

Figure 7B:
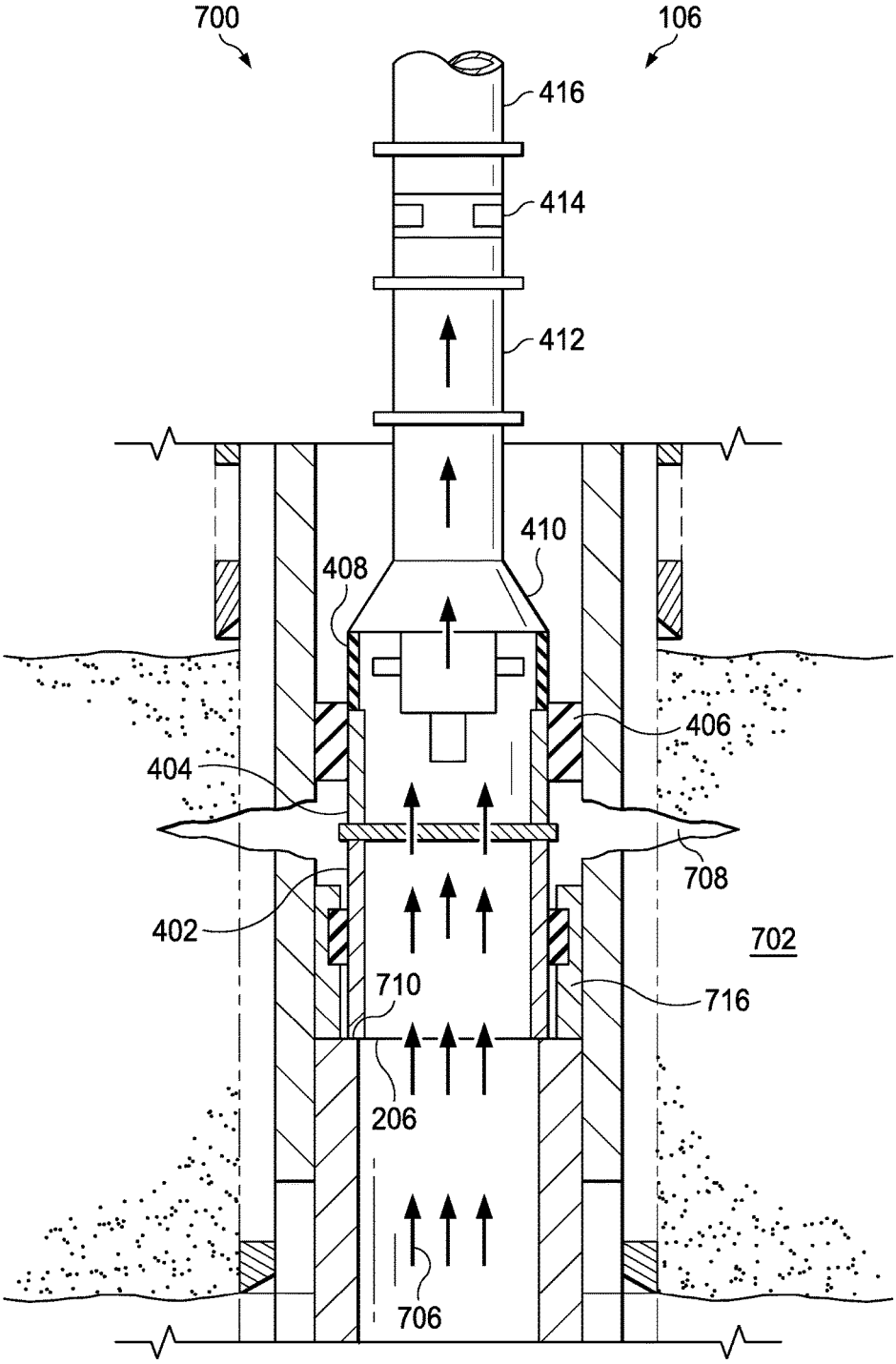
FIG. 7B is a schematic diagram of the wellbore tool positioned in the injection wellbore experiencing the cross flow.

As shown in FIG. 7B, wellbore tool 106 is assembled and lowered into the wellbore to divert the uncontrolled well fluids in an uphole direction away from the leak in the cased wellbore in the example situation. Prior to assembling the wellbore tool 106, an upward force generated by fluid flow in the uphole direction is determined. A weight of the wellbore tool 106 is selected to be greater than the determined upward force. Individual components of the wellbore tool 106 are selected such that the assembled wellbore tool 106 has the selected weight. In addition, the individual components are selected such that the wellbore tool 106 has a length sufficient to extend from above the leak 708 to an uphole end of the casing section that is immediately downhole of the casing section in which the leak is detected. The second pipe 416 extends to the surface of the wellbore.

Referring back to FIG. 6, at 604, the assembled wellbore tool 106 is run into the injection well 700 and seated on a casing section downhole of the leak, in the case presented in FIG. 7B, point 710. The metal-to-metal contact with the weight of the wellbore tool 106 is enough to overcome the upward fluid flow 706. The upward fluid flow 706 enters the open downhole end 206 of wellbore tool 106 where the modified tie-back stem diverts the upward fluid flow 706 away from leak 708 and towards flow control sub 414. The upward fluid flow 706 is stopped at flow control sub 414 due to its unidirectional valve that only allows fluid to flow in a downhole direction. The outer diameter of the tie-back stem is greater than outer diameter of the existing bottom casing. For example, if we have a 7" casing section below leak 708, the tie-back stem could have an outer diameter of 7.25", but the casing tie-back sleeve 716 can have an inner diameter of 7.5". The tie-back stem will sting into the casing tie-back sleeve 716

Figure 7C:
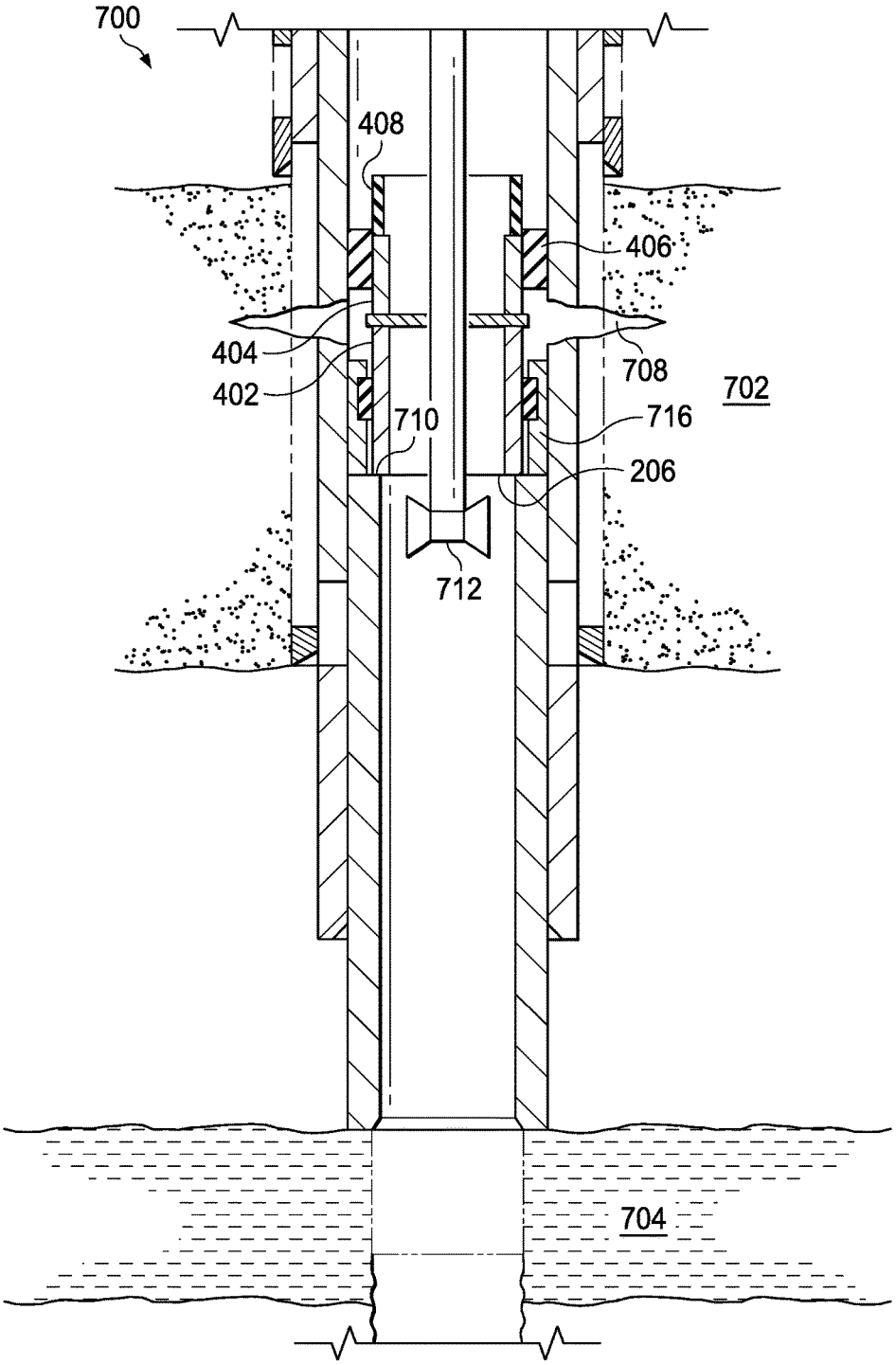
FIG. 7C is a schematic diagram of a flowmeter lowered into the wellbore to check for cross flow.
Figure 7D:
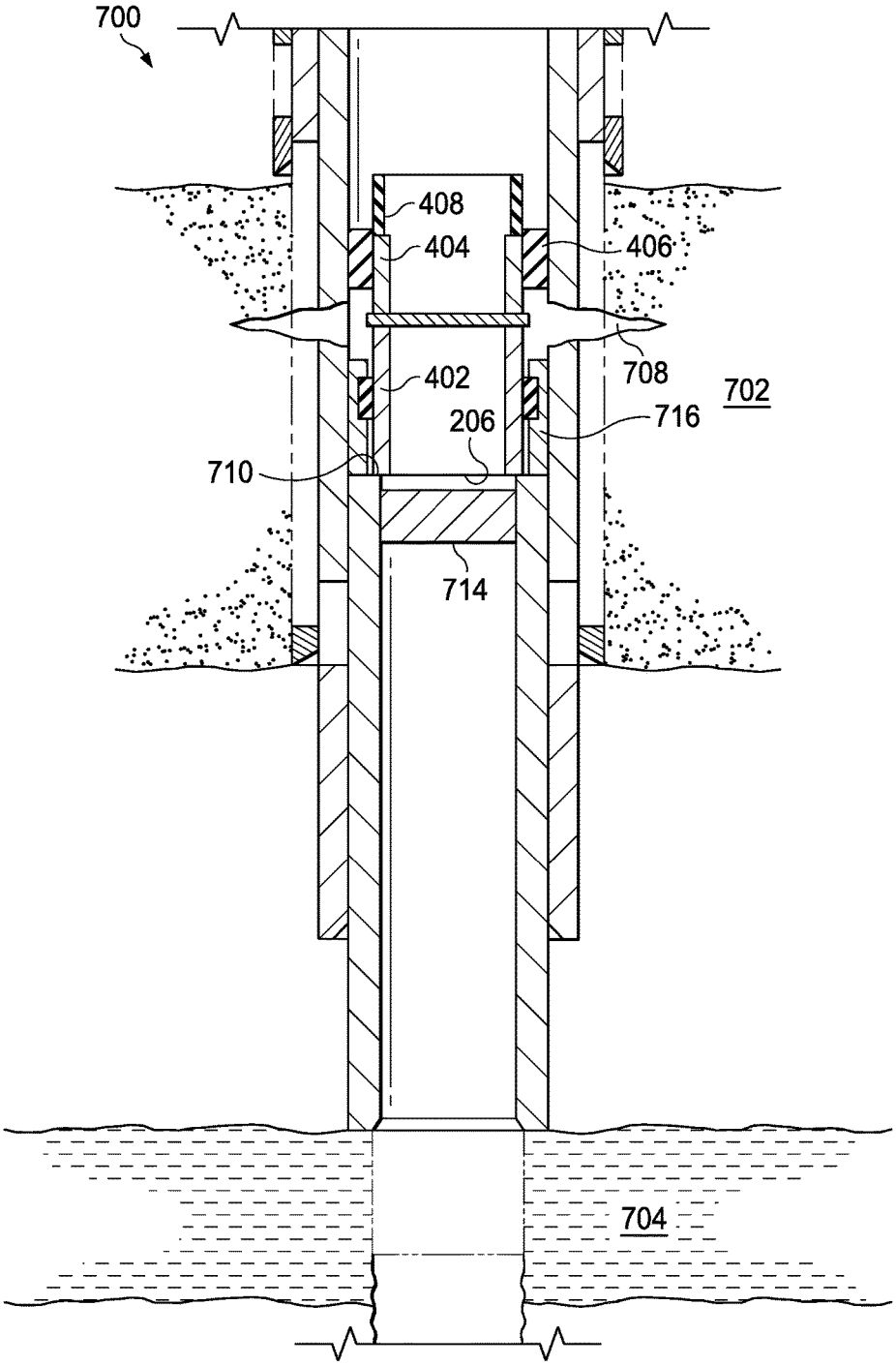
FIG. 7D is a schematic diagram of a mechanical plug or barrier positioned downhole to prevent crossflow.

At 606, killing fluid is then pumped, for example, from fluid tank 108 via the mud pump 110, through the BOP 114, and down through the uphole end of the wellbore tool 106. The killing fluid provides enough hydrostatic pressure to stop upward fluid flow 706 and kill the well. Calculations for the required amount and weight of kill fluid are calculated to have an acceptable overbalance pressure value over the expected reservoir pressure. As shown in FIG. 7C, once the flow has stopped, the second pipe 416, flow control sub 414, the first pipe 412, and the liner running tool 410 are removed from the wellbore while the liner tie back sleeve 408, top packer without slips 406, the casing joint 404, and the modified liner tie-back stem 402 are left in the wellbore. A flowmeter 712 is lowered into the hole to measure the flow-rate and confirm that all fluid flow has stopped. The flow meter 712 is lowered to a depth below the leak 708, such as a depth below point 710. Any flow meter 712 known to the art can be used. At 608, an acceptable downhole mechanical plug or barrier 714, shown in FIG. 7D, is installed to prevent any further cross flow once it has been determined that the cross flow has ceased. Then, the packer without slips 406, casing joint 404, and modified liner tie-back stem 402 are fished (removed) from the wellbore, and repairs can commence. The scenario illustrated in FIGS. 7A-7D is only an example and is not meant to limit the scope of wellbore tool 106. For example, wellbore tool 106 could be used to kill a production well instead of an injection well.

Thus, particular implementations of the subject matter have been described. Other implementations are within the scope of the following claims. In some cases, the actions recited in the claims can be performed in a different order and still achieve desirable results. In addition, the processes depicted in the accompanying figures do not necessarily require the particular order shown, or sequential order, to achieve desirable results.

What is claimed is:

1. A method comprising:

detecting a leak in a cased wellbore comprising a plurality of casing sections, wherein a fluid is flowing in an uphole direction through the cased wellbore, wherein the flow of the fluid in the uphole direction results in a first force in the uphole direction, wherein the leak is in a first casing section; and in response to detecting the leak, seating an open downhole end of a wellbore tool having a weight at least equal to a second force greater than the first force on an uphole end of a second casing section that is downhole from a location of the leak in the first casing section, wherein the open downhole end of the wellbore tool contacts the uphole end of the second casing section and restricts fluid flow toward the leak, wherein the fluid flowing in the uphole direction flows into at least a portion of the wellbore tool, wherein the wellbore tool comprises a unidirectional valve uphole of the open downhole end of the wellbore tool, the unidirectional valve configured to prevent upward flow of the fluid towards the surface, wherein the method further comprises:

pumping a kill fluid from the surface through an uphole end of the wellbore tool, the kill fluid configured to provide a hydrostatic head sufficient to prevent the fluid from flowing in the uphole direction; and installing a mechanical barrier below the wellbore tool after the fluid flowing in an uphole direction through the cased wellbore has been stopped by the kill fluid.

2. The method of claim 1, wherein the wellbore tool comprises:

a wellbore tool sub-assembly connected to an uphole end of the unidirectional valve, the wellbore tool sub-assembly extending to the surface of the wellbore, the wellbore tool sub-assembly comprising a first pipe connected to the uphole end of the unidirectional valve, a second pipe connected to a downhole end of the unidirectional valve, a liner running wellbore tool connected to a downhole end of the second pipe, wherein a downhole end of the liner running wellbore tool is configured to connect to a liner sleeve, a casing joint configured to connect to a downhole end of liner sleeve, a packer connected to an uphole end of the casing joint, and a modified liner stem connected to a downhole end of the casing joint, wherein the open downhole end of the wellbore tool is a downhole end of the liner modified stem, wherein the modified liner stem comprises a liner without a half mule shoe, wherein the method further comprises:

removing the liner running tool, the first pipe, the unidirectional valve, and the wellbore tool sub-assembly from the wellbore, wherein the liner sleeve, packer, the casing joint and the modified liner stem remain in the wellbore.

3. The method of claim 2, wherein the wellbore tool further comprises one or more O-rings attached to an outer surface of the modified liner stem, wherein the method further comprises additionally sealing the open downhole end of the wellbore tool against the uphole end of the second casing section using the one or more O-rings.

4. The method of claim 2, wherein either the first pipe or the second pipe comprises a drill collar.

5. The method of claim 2, further comprising:

determining an absence of fluid flow in the wellbore; and in response to determining the absence of the fluid flow in the wellbore, removing the packer, the casing joint and the modified liner stem.

6. The method of claim 5, further comprising initiating repair of the leak after removing the packer, the casing joint and the modified liner stem.

7. The method of claim 5, wherein determining the absence of the fluid flow in the wellbore comprises:

lowering a flowmeter into the wellbore; and measuring a rate of the fluid flow in the wellbore using the flowmeter.

8. The method of claim 1, wherein the cased wellbore is an injection wellbore.

9. The method of claim 1, wherein the cased wellbore is formed in a formation comprising a plurality of zones, wherein the leak is a cross flow from a first zone to a second zone that is uphole of the first zone and at a lower pressure than the first zone.

10. A method comprising:

in a cased wellbore comprising a plurality of casing sections, wherein a fluid is flowing in an uphole direction through the cased wellbore, wherein the flow of the fluid in the uphole direction results in a first force in the uphole direction, wherein a first casing section has a leak, seating an open downhole end of a wellbore tool having a weight at least equal to a second force greater than the first force on an uphole end of a second casing section that is downhole from a location of the leak in the first casing section, the wellbore tool comprising:

a modified liner stem comprising the open downhole end configured to contact with the uphole end of the second casing section and configured to divert the fluid flowing in the uphole direction away from the leak, wherein the modified liner stem comprises a liner stem without a half mule shoe, a casing joint connected to an uphole end of the modified liner stem;

a packer connected to an uphole end of the casing joint, wherein an uphole end of the casing joint is connected to a liner sleeve, a liner running tool connected to the liner sleeve, a first pipe connected to an uphole end of the liner running tool, a unidirectional valve connected to an uphole end of the first pipe, the unidirectional valve configured to receive the diverted fluid and to prevent flow of the diverted fluid in the uphole direction, and a wellbore tool sub-assembly connected to an uphole end of the unidirectional valve, the wellbore tool sub-assembly comprising a second pipe connected to the uphole end of the unidirectional valve.

* * * * *